US006298707B1

(12) United States Patent
Fleps et al.

(10) Patent No.: US 6,298,707 B1
(45) Date of Patent: Oct. 9, 2001

(54) CRIMPING TOOL

(76) Inventors: Paul Fleps, Martin-Luther-Strasse 1; Frank Hanke, George-Zink-Strasse 2; Wolfgang Hanke, Hans-Thoma-Strasse 7, all of D-74889 Sinsheim (DE)

( * ) Notice: Subject to any disclaimer, the term of this patent is extended or adjusted under 35 U.S.C. 154(b) by 0 days.

(21) Appl. No.: 09/564,744

(22) Filed: May 4, 2000

Related U.S. Application Data

(63) Continuation of application No. PCT/DE98/03349, filed on Nov. 9, 1999.

(30) Foreign Application Priority Data

Nov. 7, 1997 (DE) ..... 197 49 260
Nov. 10, 1997 (DE) ..... 197 50 770

(51) Int. Cl.[7] ..... B21J 13/10
(52) U.S. Cl. ..... 72/420; 72/421; 72/441; 72/712; 29/753; 29/863
(58) Field of Search ..... 72/17.3, 420, 421, 72/441, 712; 29/753, 863

(56) References Cited

U.S. PATENT DOCUMENTS 4,718,160 1/1988 Bulanda et al. .
4,805,278 2/1989 Bulanda et al. .
5,577,318 11/1996 Smith et al. .
5,666,719 9/1997 Bair .
5,799,391 * 9/1998 Tillotson ..... 72/712
5,887,340 * 3/1999 Bair ..... 72/405.01
5,920,982 * 7/1999 Fudoo ..... 29/755
6,116,069 * 9/2000 Holliday ..... 72/17.3

FOREIGN PATENT DOCUMENTS 39 37 029 C1 3/1991 (DE) .

* cited by examiner

*Primary Examiner*—Ed Tolan
(74) *Attorney, Agent, or Firm*—Alston & Bird LLP

(57) ABSTRACT

A crimping tool for crimping crimp contacts, in particular crimp contacts in the form of a strip, and which includes a base body (3) which mounts a pressing device (2), and a table (4) associated with the base body for guiding the crimp contacts to a crimping position. The crimp contacts are fed to the crimping position via the table (4), and the position of the table (4) is adjustable relative to the base body along a guideway (5) so as to permit a precise and variable positioning of the crimp contacts. Also, an adjusting mechanism (6) is provided for an infinitely variable positioning of the table (4) along the guideway (5). The table (4) further includes a positioning device (20) for a functional positioning of the crimp contacts (1) relative to the table (4).

18 Claims, 4 Drawing Sheets

CRIMPING TOOL

CROSS-REFERENCE TO RELATED APPLICATIONS

This is a continuation of PCT/DE98/03349 filed Nov. 9, 1999.

BACKGROUND OF THE INVENTION

The present invention relates to a crimping tool for crimping crimp contacts, in particular crimp contacts in the form of a strip, with a base body comprising a pressing device and a table associated to the base body for guiding the crimp contacts, the crimp contacts being advanced to the pressing device via the table, and the position of the table being variable relative to the base body along a guideway.

Furthermore, the invention relates to a crimping tool for crimping crimp contacts, in particular crimp contacts or terminals in the form of a strip which are intended to be crimped onto wires or the like, with a base body comprising a pressing device and a table associated to the base body for guiding the crimp contacts, the crimp contacts being fed to the pressing device via the table.

Crimping tools of the described type have been known from practice for a long time, and they exist in a large variety of designs. The known crimping tools are designed and constructed for a streamlined processing of crimp contacts in the form of a strip, in a longitudinal or transverse movement, or for sortable individual contacts. Frequently, the known crimping tools are designed and constructed as quick-change tools, and they can be used in individual workstations or fully automatic machines and transfer lines. In this connection, it is possible to handle electric conductors with a cross sectional area from about 0.08 $mm^2$ to 50 $mm^2$.

With respect to a stable and precise crimping, it is necessary that the crimp contacts be exactly fed to the pressing device in alignment with the position of the crimping stamp. To this end, it is known to provide a positioning of the table relative to the base body along a guideway. This permits influencing the feed direction of the crimp contacts.

In a known crimping tool, the table is guided in two grooves formed in the base body. The table is secured relative to the base body by means of clamping screws. To change the position, it is necessary to first loosen the clamping screws. Subsequently, the position of the table is adjusted, and finally the clamping screws are retightened.

On the one hand, such a positioning of the table is expensive because of the three last-mentioned steps, and on the other hand, it is often not possible to prevent the table from canting in the groove-type guideways. This increases the wear of the crimping tool considerably.

Furthermore, the known positioning operation often does not permit an adequate adjustment of the table relative to the base body. However, a precise adjustment is desirable for the reason that even slight adjustment errors can lead to the formation of frequently undesired flanges—so-called crimp trumpets—in the region of the pressed crimp contacts.

It is therefore an object of the present invention to provide a crimping tool of the initially described type, wherein a precise and variable positioning of the crimp contacts is attained with simple means.

SUMMARY OF THE INVENTION

The above and other objects and advantages of the present invention are achieved by the provision of a crimping tool which comprises a base body which includes a crimp pressing device mounted for vertical reciprocation, and a table for guiding the crimp contacts in a feed direction to a crimping position which is aligned with the crimp pressing device. The table is interconnected to the base body by an adjusting mechanism which permits the position of the table to be infinitely variable relative to the base body along a guideway which extends in a direction perpendicular to the feed direction.

The adjusting mechanism preferably includes a threaded member extending in the direction of the guideway through an opening in the table and to a threaded bore in the base body.

In the development of the preset invention, the number of steps to change the position of the table is reduced. Only by actuating the adjusting mechanism is it possible to attain the desired position. A canting of the table in the guideway is prevented by the infinitely variable positioning capability. At the same, the variability of the positioning is increased. The disadvantages of the known positioning operation, which permitted in practice in most cases only a stepwise positioning of the table because of the impractical handling, are avoided with the infinitely variable positioning capability according to the crimping tool of the present invention.

Consequently, the crimping tool of the present invention realizes a crimping tool, wherein a precise and infinitely variable positioning of the crimp contacts is attained with simple means.

The adjusting mechanism preferably also comprises an elastic member that is operative between the table and the base body in direction of the guideway. With respect to a stable position of the table, it would further be possible that the elastic means pushes the table against a stop associated to the base body. The position of the stop could then again be variable relative to the base body in the direction of the guideway, so that a positioning of the table can be realized only by changing the position of the stop. This would result in a particularly simple positioning.

In a constructionally simple manner, the elastic member could be a helical spring. However, it would also be possible to use here leaf springs or the like.

As regards a particularly reliable arrangement of the elastic member, the elastic member could extend around the stop. When the elastic member is designed and constructed as a helical spring, it will be possible to arrange the stop within the threads of the spring.

A further, particularly simple construction could be realized wherein the stop is a screw, preferably a hollow screw, which extends through the table and is screwed into a screw thread in the base body. This would permit an adjustment of the position of the table relative to the base body by only engaging and disengaging the screw. The position of the table would then be secured relative to the base body by applying pressure through the elastic member. To this end, the elastic means could further be arranged in a recess in the table. This would permit a particularly reliable and precise application of pressure.

Furthermore, with respect to a particularly reliable positioning of the table, the screw could be self-locking. In this connection, it would be possible to insert a plastic material into the screw thread in the base body. As an alternative or in addition thereto, it would be possible to secure the screw against an unwanted disengagement by applying pressure. This pressure application could also occur by the elastic member.

A further possibility of securing the position of the screw in the screw thread could occur by a pin that is screwed through the base body toward the screw. The screw thread for the pin would quasi extend into the thread of the screw. In a particularly simple manner, the pin could be a set screw.

In an alternative development, the stop could also be associated to the table. In this instance, the screw would engage the table through the base body. The screw could then be secured against an unwanted disengagement in a manner analogous to the foregoing description.

As regards a particularly simple and yet reliable guidance, the guideway could comprise at least one pin and preferably two pins associated to the base body and/or the table. The pins could extend in recesses formed in the table or in the base body. Such recesses could be realized in a simple manner by bores.

In addition to designing the pins as round posts, it would also be possible to provide pins with a dovetail profile or a square profile. In particular in the case of the last-mentioned profile shapes, the design of a pin would be adequate for a reliable hold.

Finally, the table could also be guided in a conventional manner in a groove formed in the base body. In this instance, a safety would have to be provided, if need be, against a lifting of the table from the groove.

To ensure a particularly simple, automatic feed of the crimp contacts to the pressing device, it would be possible to associate to the base body a feed unit for the crimp contacts. In this instance, the feed unit could be a push element and a feed finger capable of reciprocating in the feed direction of the crimp contacts. This feed finger could be operatively connected to the push element via a coupling element.

With respect to a reliable operation of the feed unit, the feed finger could be guided along a side of the table, preferably by means of the table. In this instance, feed finger would move quasi within a groove, which could be formed by one side of the table and a cover element arranged on the table side. The cover element could be designed and constructed as a plate and be screwed to the table side.

When the position of the table is changed, there arises the problem with conventional crimping tools that it is also necessary to adjust the position of the feed finger, and thus lastly the distance of the feed finger from the table, to the change in the position of the table. If such an adaptation of the position of the feed finger is omitted, this omission can result in a slipping of the feed finger on the table, or in its canting, which leads directly to an increased wear and to an impaired operation of the crimping tool. For this reason, the crimping tool could be designed and constructed in an advantageous manner such that the spacing between the feed finger and the table remains constant during and after the actuation of the adjusting mechanism. To this end, the coupling element could extend in the feed finger such that the spacing of the coupling element and feed finger changes during the actuation of the adjusting mechanism to the same degree as the spacing of the table and base body. In this connection, it would be advantageous to guide the feed finger below the table in a groove consisting of two guide strips that extend in the feed direction. The guide strips could be made integral with the table or be bolted to the table from the bottom.

In the same manner, it would be possible to extend the coupling element perpendicular to the feed direction within two guide strips of the feed finger, which are arranged in the form of a groove. This would prevent damage or an impaired operation of the crimping tool.

As a further aspect of the invention, the table may mount a positioning device for a functional positioning of the crimp contacts relative to the table. With this embodiment, the crimp contacts can also be positioned, if need be, without positioning the table relative to the base body. Thus, the requirement for positioning the table relative to the base body, while accepting the known disadvantages, is avoided in an elegant manner. Furthermore, there will no longer arise the problem of a jamming feed finger, which is not adapted to an adjustment of the table.

With respect to a crimping tool of a particularly simple design, the positioning device for positioning the crimp contacts could comprise a guide element designed and constructed so as to extend perpendicular to the feed device. With that, it would be possible to predetermine the feed direction for the crimp contacts in a simple manner.

To ensure a simple positioning of the crimp contacts perpendicular to the feed direction, the guide element could be movable perpendicular to the feed direction. As regards a long guide length and thus a particularly reliable positioning, the guide element could extend in the feed direction. In this connection, the guide element could furthermore be made in the form of a generally flat plate and be arranged perpendicular to the table surface. Such a plate-shaped configuration would allow the guide element to engage during the operation of the crimping tool in a particularly reliable manner between at least two contact elements of the crimp contacts, which are to be bent. In other words, the plate-shaped guide element extending perpendicular to the table surface is arranged between contact elements of crimp contacts advancing on the table, which project vertically from the table. In this arrangement, the guide element could be aligned along a crimp contact strip.

For an adaptation to differently dimensioned crimp contacts, the distance of the guide element could be variable relative to the table. In this connection, it is to be ensured that the crimp contacts or the crimp contact strip are able to slide through safely between the guide element and the table, without enabling a noteworthy movement of the crimp contacts perpendicular to the feed direction.

With respect to a particularly reliable arrangement of the guide element, the latter could be attached to the table by a holding device. The holding device could comprise at least one bar, the one end of which mounts the guide element.

The guide element could be secured in position on the bar by clamping the guide element by means of a screw extending through the guide element and engaging the bar in the axial direction thereof. In the assembled state, the bar could then be arranged perpendicular to the feed direction and in a plane extending parallel to the plane of the table.

As regards a simple distance variation of the guide element relative to the table, the guide element could be provided with an elongate hole for the screw. A distance or vertical adjustment of the guide element could then occur by loosening the screw, displacing the guide element, and tightening the screw.

With respect to a particularly simple arrangement of the bar, the holding device could comprise at least one receiving element for the bar or bars. In this connection, the receiving element could comprise at least one passageway for the bar or bars. The receiving element could be designed and constructed in one piece with a plurality of passageways for receiving a plurality of bars, or as an individual element for receiving only one bar.

With respect to a simple securement of the bars in the passageway, the bar or bars could be adapted for being clamped in the passageway in different positions. With that, it would be possible to realize a simple positioning of the guide element in a direction perpendicular to the direction of feed. To ensure a reliable clamping of the bar in the passageway, the clamping could occur via a clamping screw that is screwed through the receiving element. The screw thread provided for the clamping screw would then extend quasi to the passageway.

As regards a particularly well accessible holding means, the receiving element or receiving elements could be arranged on the table surface, and preferably be screwed thereto. Alternatively, the receiving elements could also be arranged on every second side of the table.

With respect to a particularly precise and variable positioning of the crimp contacts, a crimping tool would also be possible, wherein on the one hand an adjusting mechanism is provided for an infinitely variable positioning of the table along a guideway, and which comprises on the other hand a table with a positioning device for a functional positioning of the crimp contacts relative to the table. In such a crimping tool, it would be possible to realize in part or in full preferably the characteristic features defined herein.

There exist various possibilities of improving and further developing the teaching of the present invention. To this end, reference may be made to the following detailed description of a preferred embodiment of the invention with reference to the drawing. In conjunction with the description of the preferred embodiment of the invention with reference to the drawing, also generally preferred improvements and further developments of the teaching are described.

DETAILED DESCRIPTION OF THE INVENTION

Figure 1:
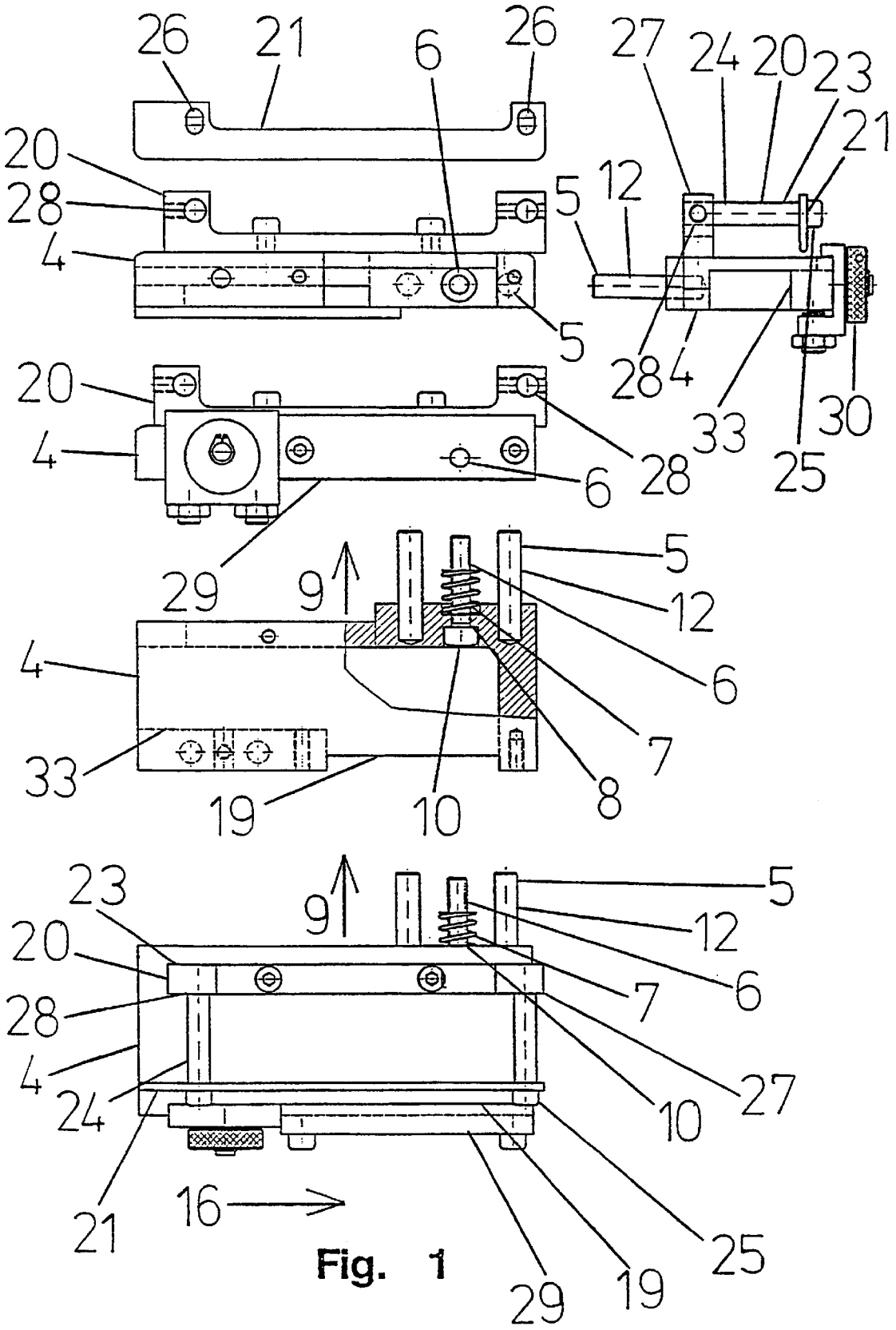
FIG. 1 comprises six partially sectioned and schematic front, top, and side views of an embodiment of a table of a crimping tool according to the invention.

FIG. 1 shows in a total of six front, top, and side views an embodiment of a table 4 of a crimping tool according to the invention. To begin with, the lower half of the illustration shows two top views of the table 4, which comprises an adjusting mechanism 6 for an infinitely variable positioning of the table 4 along a guideway 5. The adjusting mechanism 6 comprises an elastic member 7 as well as a threaded member or screw 10. The guideway 5 is constructed in the form of two pins 12. By turning screw 10 that engages a base body 3 (FIG. 5), it is possible to adjust, quasi in one step, the position of table 4 relative to the base body 3. The adjustment occurs in a guiding direction 9.

The table 4 further mounts a positioning device 20 for a functional positioning of crimp contacts 1 relative to the table 4. The positioning device 20 comprises a guide element 21, which is made in the shape of a plate and arranged perpendicular to the table surface in the direction of feed 16. In the operation of the crimping tool, the guide element 21 engages between at least two contact elements 22 of the crimp contacts 1, which are to be bent.

The glide element 21 is attached to the table 4 by means of a holding device 23. The holding device 23 comprises two bars 24, to the one end of which the guide element 21 is bolted with a screw 25. For a vertical adjustment of the guide element 21, the guide element 21 comprises elongate holes 26. With that, it is possible to vary the guide element in its position relative to the bars 24. The bars 24 extend through passageways 28 in a receiving element 27 of the holding device 23. The receiving element 27 is arranged on the table surface and bolted thereto.

To change the distance of the guide element 21 relative to the base body 3 or perpendicular to the direction of feed 16, it is possible to vary the position of bars 24 in the passageway 28.

A feed finger 17 (FIG. 2) extends along a table side 19, with its guidance being optimized by means of a plate 29 screwed to the table side 19.

The second illustration from the bottom in FIG. 1 is likewise a top view of the table 4. In this instance, a sectioned view below the plane of the table surface has been selected. As can be noted therefrom, the screw 10 forms a stop 8 for the table 4. Below the table surface, the table includes quasi a recess, which forms a guide range 33 for the feed finger 17.

The three upper illustrations in the left half of FIG. 1 are a front view of the table 4 and guide element 21, respectively. These illustrations show best the passageways 28 for receiving the bars 24. The guide element 21 shown in the topmost illustration comprises two elongate holes 26 for the vertical adjustment of the guide element 21 relative to the table 4.

The right half of FIG. 1 is a side view of the table 4. This illustration shows best the guide range 33 for the feed finger 17. The table 4 further comprises a clamping device 30 for the crimp contacts 1. The clamping device 30 prevents the crimp contacts 1 or a strip of crimp contacts 1 from lifting during the operation of the crimping tool.

Figure 2:
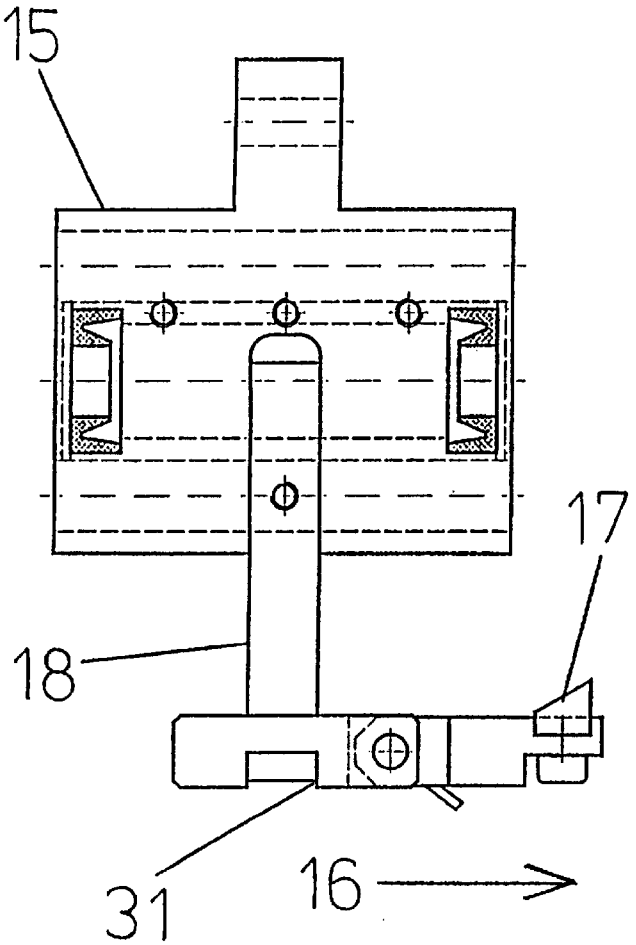
FIG. 2 is a schematic front view of the push element with a coupling element and feed finger of the embodiment.

FIG. 2 is a schematic front view of a push element 15 of a feed unit 14. The push element 15 connects to the feed finger 17 via a coupling element 18. To prevent the feed finger 17 from canting in its guideway during a change of the table position relative to the base body 3 by means of the adjusting mechanism 6, a groove 31 is formed in the feed finger 17 for guiding the coupling element 18. The coupling element 18 extends in the feed finger 17 such that during the actuation of the adjusting mechanism 6, the spacing of coupling element 18 and feed finger 17 changes to the same extent as the spacing of table 4 and base body 3.

Figure 3:
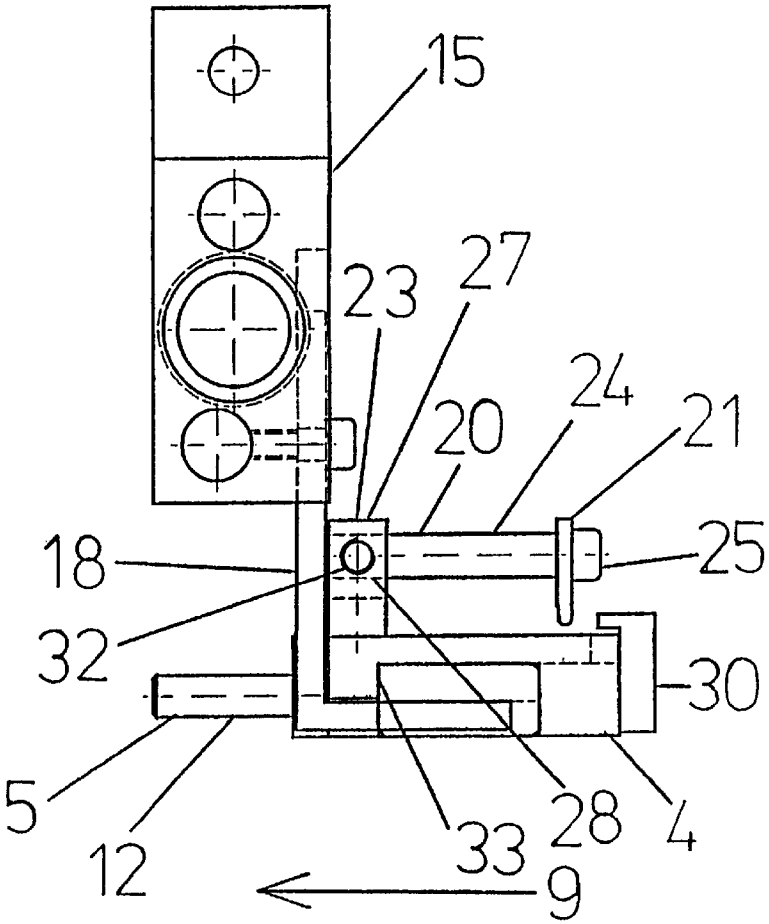
FIG. 3 is a schematic side view of the push element with coupling element and table of the embodiment.

FIG. 3 is a schematic side view of the push element 15 with the coupling element 18 and table 4 of the embodiment. For the sake of clarity the feed finger 17 is not shown in the illustration. The table 4 comprises pins 12 forming the guideway 5 for engaging the base body 3. Furthermore, the table is associated with a positioning device 20 for crimp contacts 1. The positioning device 20 comprises a receiving element 27 for the bars 24, to which a guide element 21 is attached with a screw 25. The bars 24 extend in passageways 28 formed in the receiving element 27. For clamping the bars 24, a set screw 32 is provided in the passageway 28. Together, the bars 24 and the receiving element 27 form a holding device 23.

For clamping the crimp contacts 1, a clamping device 30 is provided on the table 4. Furthermore, the table 4 comprises a guide range 33 for the feed finger 17 not shown in the Figure.

Figure 4:
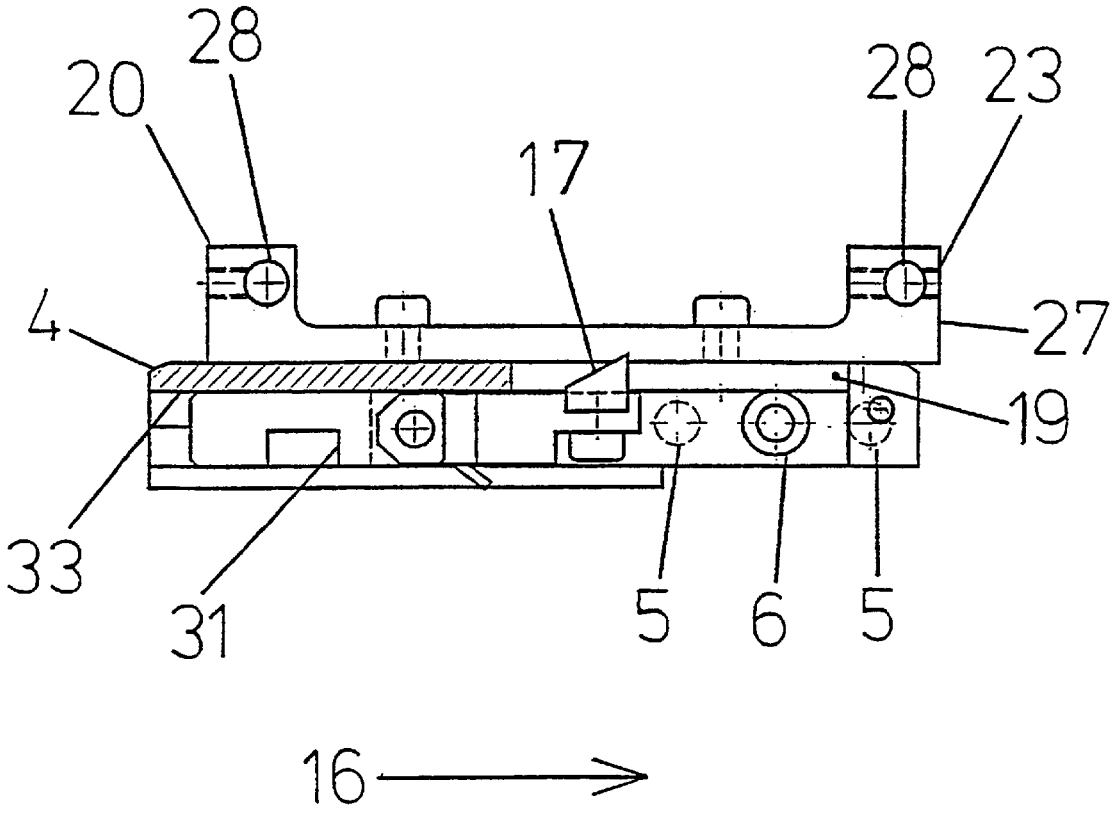
FIG. 4 is a partially sectioned and schematic front view of the table of the embodiment.

FIG. 4 is a partially sectioned and schematic front view of the table 4. The illustrated view of the partially sectioned table 4 shows best the range of movement of the feed finger 17 along the table side 19 and in the guide range 33. Also shown is the groove 31 of the coupling element 18.

Furthermore, the Figure shows the positioning device 20 with the holding device 23 and the receiving element 27. To accommodate the bars 24, passageways 28 are provided.

Figure 5:
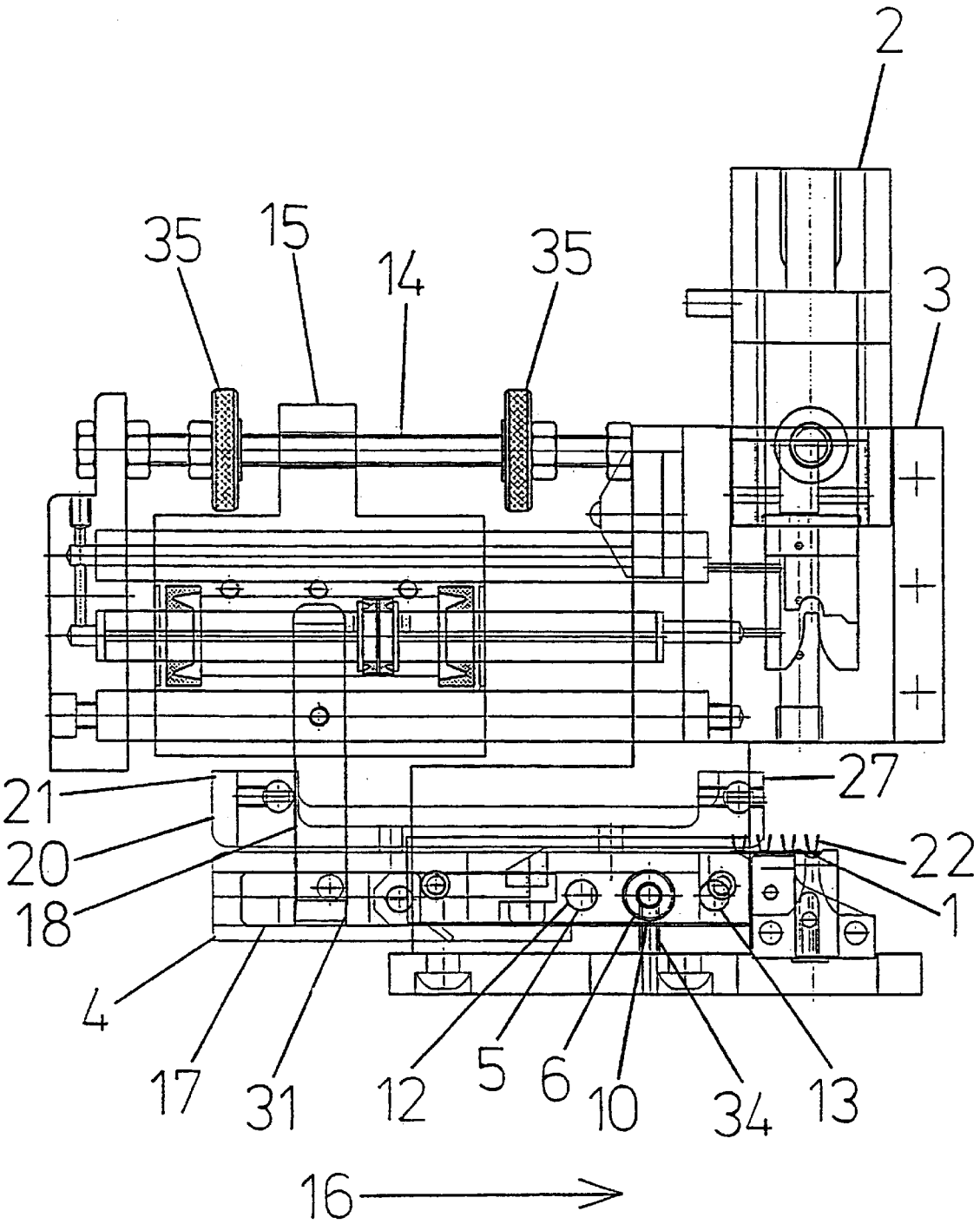
FIG. 5 is a schematic front view of the embodiment of the crimping tool according to the invention.

FIG. 5 is a schematic front view of the entire embodiment of the crimping tool according to the invention. The crimp contacts 1 advance on the table 4 and comprise contact elements 22. The table 4 is movable relative to the base body 3, which comprises a pressing device 2. The guideway 5 for moving the table 4 relative to the base body 3 comprises an adjusting mechanism 6, which permits an infinitely variable adjustment of the position of the table 4 relative to the base body 3. The guideway 5 comprises pins 12, which extend in receptacles 13 of the base body 3.

Associated to the base body 3 is the feed unit 14 for the crimp contacts with push element 15. The push element 15 is adapted for reciprocal movement between two stops 35. During each reciprocating movement of the push element 15, the strip of crimp contacts 1 advances in the direction of feed 16 toward the pressing device 2. The table 4 mounts a positioning device 20 with a guide element 21. The guide element 21 engages the contact elements 22 of the crimp contacts 1. On the table 4, the guide element 21 is secured in its position via bars 24 and a receiving element 27. The feed finger 17 includes a groove 31 for engaging the coupling element 18.

For locking the adjusting mechanism 6 or the screw 10 provided therefor, the base body 3 contains a screw thread 34 for a pin. The pin may be a set screw, and for purposes of locking, it is screwed against the screw 10.

The crimping tool of the present invention permits an adaptation to all commercially available crimp contacts 1 with a standard component in the form of the table 4 with the positioning device 20. In the past, it has been necessary to use a separate table 4 for each different crimp contact 1. The simple positioning of the crimp contacts 1 with the crimping tool of the present invention makes it possible to avoid so-called crimp trumpets as described above.

As regards further advantageous improvements and further developments of the teaching in accordance with the invention and for purposes of avoiding repetitions, the general part of the specification on the one hand and the attached claims on the other are herewith incorporated by reference.

Finally, it should be explicitly remarked that the foregoing, merely arbitrarily selected embodiment serves only for explaining the teaching of the invention without however limiting same to this embodiment.

That which is claimed:

1. A crimping tool for crimping crimp contacts in the form of a strip, and comprising a base body which includes a crimp pressing device which is mounted for vertical reciprocation, a table for guiding the crimp contacts in a feed direction to a crimping position which is aligned with the crimp pressing device, and an adjusting mechanism interconnecting the table to the base body so as to permit the position of the table to be infinitely variable relative to the base body in opposite directions along a guideway which extends in a direction perpendicular to the feed direction, said adjusting mechanism including a threaded member extending in the direction of the guideway and through an opening in one of the table and the base body and engaging a threaded bore in the other of the table and the base body and so as to form a stop between the threaded member and opening, and an elastic member for biasing the table and the base body relative to each other in the direction of the guideway and against the stop.

2. The crimping tool as defined in claim 1 wherein the elastic member comprises a helical coil spring which is disposed coaxially about said threaded member.

3. The crimping tool as defined in claim 1 further comprising locking means for preventing the unintended rotation of the threaded member.

4. The crimping tool as defined in claim 1 wherein the guideway comprises at least one pin mounted to one of the base body and table and extending into a recess formed in the other of the base body and table.

5. The crimping tool as defined in claim 1 further comprising a contact feed unit mounted for movement on said base body in the feed direction.

6. The crimping tool as defined in claim 5 wherein the feed unit comprises a push element which mounts a feed finger and which is mounted for reciprocal movement in the feed direction, and with the feed finger being guided along one side of the table.

7. The crimping tool as defined in claim 6 wherein the feed finger is mounted to the push element via a coupling element.

8. The crimping tool as defined in claim 7 wherein the coupling element is slideably connected to the feed finger so as to permit relative movement in the direction of the guideway, and whereby the positioning of the feed finger relative to the table remains constant during actuation of the threaded member.

9. The crimping tool as defined in claim 1 wherein the table includes a table surface which extends along the feed direction and is perpendicular to the vertical reciprocation of the crimp pressing device, and wherein the direction of the guideway is perpendicular to the vertical reciprocation of the crimp pressing device and to the feed direction.

10. The crimping tool as defined in claim 9 further comprising a positioning device for positioning the crimp contacts relative to the table surface.

11. The crimping tool as defined in claim 10 wherein the positioning device comprises a guide element which is moveable in the direction of the guideway so as to move the crimp contacts in a direction perpendicular to the feed direction on the table surface.

12. The crimping tool as defined in claim 11 wherein the guide element is in the form of a generally flat plate which is perpendicular to the table surface and extends in the feed direction.

13. The crimping tool as defined in claim 1 wherein the opening of said adjusting mechanism is in said table and the threaded bore is in the base body.

14. The crimping tool as defined in claim 13 wherein the elastic member comprises a helical coil spring which is disposed coaxially about said threaded member and so as to engage both said table and said base body.

15. A crimping tool for crimping crimp contacts in the form of a strip, and comprising a base body which includes a crimp pressing device which is mounted for vertical reciprocation, a table having a table surface upon which the crimp contacts are guided in a feed direction to a crimping position which is aligned with the crimp pressing device, and an adjusting mechanism interconnecting the table to the base body so as to permit the position of the table to be infinitely variable relative to the base body in opposite directions along a guideway which extends in a direction perpendicular to the feed direction, and a positioning device mounted to said table for adjustably positioning the crimp contacts in the guideway direction relative to the table surface.

16. The crimping tool as defined in claim 15 wherein the positioning device comprises a guide element which is in the form of a generally flat plate which is perpendicular to the table surface and extends in the feed direction.

17. The crimping tool as defined in claim 16 further comprising a contact feed unit mounted for reciprocal movement on said base body in the feed direction, said contact feed unit comprising a push element which mounts a feed finger via a coupling element, with the coupling element being mounted to the feed finger for relative sliding movement in the direction of the guideway, and whereby the positioning of the feed finger relative to the table remains constant during actuation of the threaded member.

18. The crimping tool as defined in claim 16 further comprising means mounting the flat plate to the table for adjustment in a vertical direction with respect to the table surface and for adjustment in the guideway direction.

* * * * *

UNITED STATES PATENT AND TRADEMARK OFFICE

CERTIFICATE OF CORRECTION

PATENT NO. : 6,298,707 B1
DATED : October 9, 2001
INVENTOR(S) : Fleps et al.

It is certified that error appears in the above-identified patent and that said Letters Patent is hereby corrected as shown below:

Title page,
Item [63], Related U.S. Application Data, "Nov. 9, 1999" should read -- Nov. 9, 1998 --.
Item [30], Foreign Application Priority Data, "197 49 260" should read -- 197 49 260.6 --; and "197 50 770" should read -- 197 50 777.0 --.

Signed and Sealed this

Twenty-first Day of January, 2003

JAMES E. ROGAN
*Director of the United States Patent and Trademark Office*